US005588160A

United States Patent [19]

Nichols

[11] Patent Number: 5,588,160

[45] Date of Patent: Dec. 31, 1996

[54] TOTAL BODY BRUSH SHOWER

[76] Inventor: Timothy G. Nichols, Rte. 4, Box 250, Galax, Va. 24333

[21] Appl. No.: 523,552

[22] Filed: Sep. 5, 1995

[51] Int. Cl.[6] ..... A47K 7/02

[52] U.S. Cl. ..... 4/606; 15/227

[58] Field of Search ..... 4/606; 15/21.1, 15/88.2, 88.3, 97.1, 104.92, 227

[56] References Cited

U.S. PATENT DOCUMENTS

| | | | |
|---|---|---|---|
| 4,014,051 | 3/1977 | Pettit | 15/104.92 X |
| 4,554,699 | 11/1985 | Simmons | 15/160 X |
| 5,490,302 | 2/1996 | Dion | 4/606 X |
| 5,520,618 | 5/1996 | Massiet | 4/104.92 X |

*Primary Examiner*—Charles E. Phillips

[57] ABSTRACT

A hand-held or wall-based shower which incorporates a shower spray nozzle or nozzles inside a body brush shaped to conform with the user's hand. This combination enables the user to realize total body bathing efficiency by scrubbing while lathering and rinsing. The apparatus consists of two separate components: a TOTAL BODY BRUSH; and a TUBING ASSEMBLY. On the front side of the brush, gentle but resilient bristles surround a shower spray nozzle or nozzles. On the back side of the brush, molded suctions cups and hook and loop material hand or finger straps are attached. With these additions, the brush and shower may be secured to any smooth surface or may be easily used manually. The tubing assembly is comprised of flexible tubing of adequate length and diameter with connections to a water source and the total body brush and a water regulator valve.

1 Claim, 7 Drawing Sheets

TOTAL BODY BRUSH SHOWER

BACKGROUND OF THE INVENTION

The most efficient method of bathing as well as most conservative in its use of water is the shower. The rinsing affect of the shower spray helps to clean the body more thoroughly and gives one a more refreshed feeling than by bathing. If one is able to scrub their body while showering, the cleaning efficiency, as well as therapeutic value of the shower is increased. Yet, many people do not fully utilize the cleaning efficiency of the shower because they fail to, or do not realize the necessity to, vigorously scrub the body while lathering and rinsing. If one's skin is not completely cleansed of dirt, dead skin, and soap residue, infections or disease can occur. Even if the bather uses a sponge or hand-held brush, the difficulty in efficiently scrubbing the back areas of the body is complicated, if not impossible.

The use of a hand-held shower is a more effective device for rinsing, since it directs the water spray more closely and forcefully against the area that is being rinsed. However, the use of a hand-held shower while using a brush or a sponge for scrubbing is not only awkward when washing the body, but ineffective when attempting to clean the back areas of the body.

The use of the customary backbrush, in all its many varieties, has never completely solved the back cleaning problem because the design of the backbrush makes it use unwelding. One cannot exert the amount of force that is needed to scrub the areas that need washing thoroughly and vigorously enough.

Although the use of a brush that attaches to the wall, as seen in U.S. Pat. No. 3,862,459, 4,704,756, 4,890,352, or 5,228,165 would be effective in scrubbing the areas of the back, they are not efficient while rinsing because the water spray will not come in contact with the areas being rinsed with enough force to be effective. Even if the bather is using a handle-held shower, there would still be no direct contact with the water spray. Also, the wall brushes cited would be awkward if used for scrubbing other areas of the body.

The hand-held brush showers, as demonstrated in U.S. Pat. No. 's 4,155,137, 4,282,623, 5,153,962, or 5,339,469, would be adequate in scrubbing some areas of the body. However, they would be no more effective than the customary backbrush in washing areas that are difficult to reach manually and would be less effective than a hand-held brush in washing easily reached areas of the body.

If one could afford to build or have built a body shower, as seen in U.S. Pat. No. 3,768,462, 4,733,421, 4,858,257, or 5,335,378, effective scrubbing of the front and back areas of the upper body could be accomplished. However, these devices are only effective while lathering. They have not been constructed to allow an effective means of directly rinsing the body while scrubbing.

While the swivel brush and shower, as seen in U.S. Pat. No. 5,065,463 would be acceptable in scrubbing and rinsing the upper back areas of the body, it is inadequate and awkward in washing the front and lowers areas.

While some of these prior devices can be used to effectively scrub while lathering difficult to reach areas of the body, to effectively rinse the body, or to scrub easily reached areas of the body while rinsing, no device has as yet been designed which can efficiently scrub while lathering and rinsing all areas of the body.

OBJECTS OF THE SUMMARY

The principle object of the TOTAL BODY BRUSH SHOWER is to improve the rinsing efficiency of a hand-held shower by incorporating the scrubbing efficiency obtained from a hand-held and a wall-based brush so that the most thorough and effective body hygiene possible is achieved. Other objectives of the invention are to: provide a device of simple and inexpensive construction that would appeal aesthetically to the average bather; increase the user's awareness of the necessity to scrub while lathering and rinsing; help reduce bath or shower clutter; and make the shower an easily available choice for all members of a household.

The TOTAL BODY BRUSH SHOWER is designed to not only be attached to the bath wall or bath tub to efficiency clean difficult areas of the body, but it can also be easily held in the hand of the user to thoroughly clean all other areas of the body. The design of the TOTAL BODY BRUSH SHOWER enables the user to efficiently scrub the entire body while lathering and rinsing with as much force as required or desired. Thus, the most effective hygiene possible is accomplished with the use of the TOTAL BODY BRUSH SHOWER.

Since the TOTAL BODY BRUSH SHOWER should be primarily made of plastic, a material that is inherently easy to keep clean, it would be an inexpensive device that can be used by all members of the same household. The ability to place the brush at any level would make the device available to any sized or aged member of a family. Using the TOTAL BODY BRUSH SHOWER would negate the need for any other brush or scrubbing device inside the shower or bath and would require the user to have the bristles in close proximity to their skin while rinsing. After use, the TOTAL BODY BRUSH SHOWER would be put up on the wall and out of the way.

DETAILED DESCRIPTION

Figure 1:
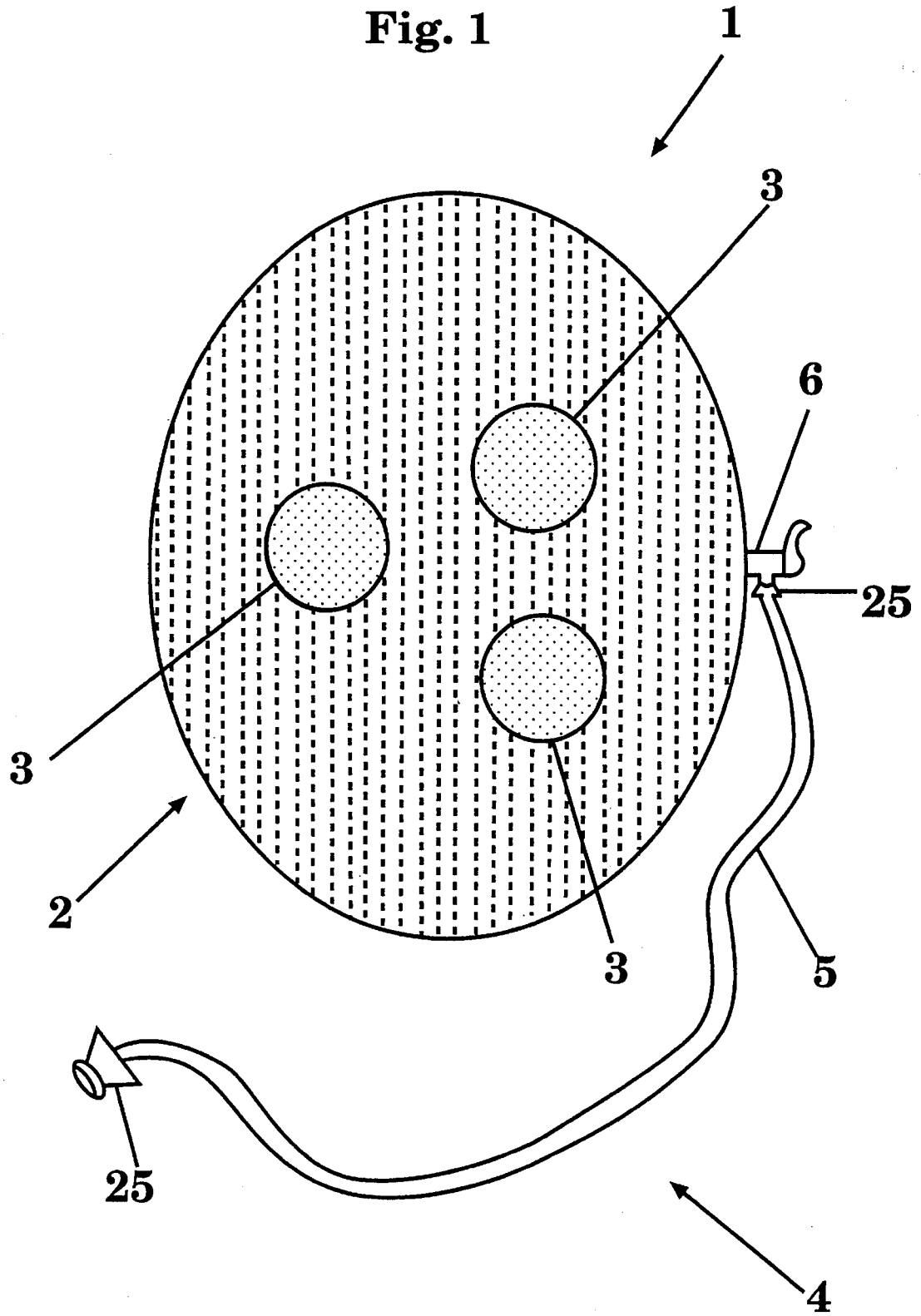
FIG. 1 is a perspective view of the preferred embodiment of the TOTAL BODY BRUSH SHOWER.

In FIG. 1, a preferred embodiment of the TOTAL BODY BRUSH SHOWER is designated by a general reference numeral (1), it is composed of two separate components: the TOTAL BODY BRUSH (2), and the TUBING ASSEMBLY (4). The TOTAL BODY BRUSH (2) in its preferred embodiment, is an oval-shaped brush with attachments that make it possible for it to be held in the hand or placed on a smooth surface. On the brush, one or more separate spray nozzles (3) are surrounded by plastic bristles. The TUBING ASSEMBLY (4) consists of a tubing line (5) that directs the flow of water from a water source into the TOTAL BODY BRUSH (2) through a regulator valve (6). The flow of water is adjusted by the regulator valve (6) positioned between the tubing line (5) and the brush (2). The TOTAL BODY BRUSH (2) should be of a shape and size that can be held comfortably in the hand of the average user. It should be made slightly larger than the average adult hand, but other shapes, sizes and colors could be made for larger or smaller hands. The tubing line (5) should preferably be of a length and diameter that would allow the user to shower without any difficulty. The total area taken up the body nozzle (3) or nozzle should be of a size that would not lessen the effectiveness of the bristles on the brush.

The TOTAL BODY BRUSH (2) is constructed by assembling three separately molded pieces together.

Figure 2:
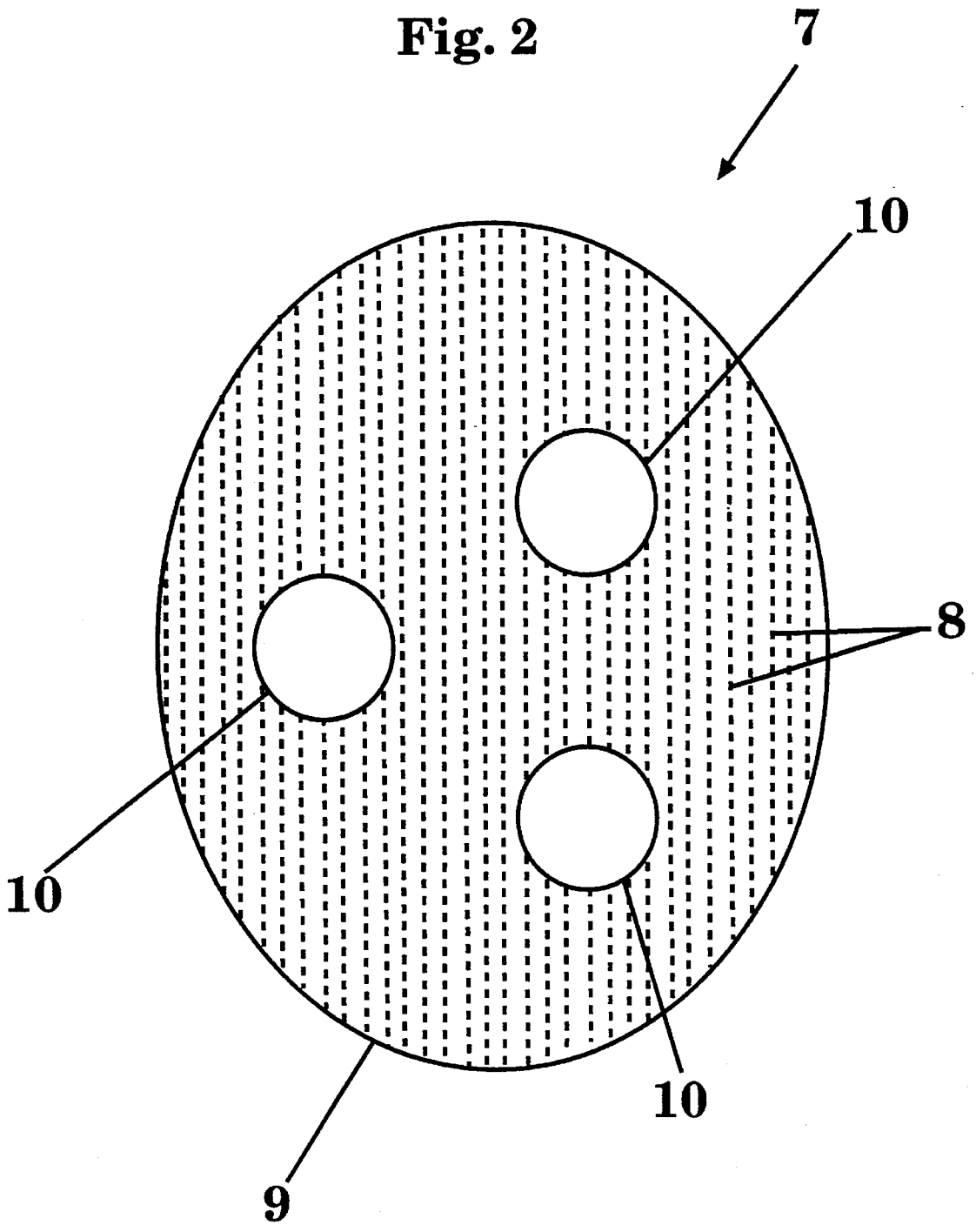
FIG. 2 is a front view of the front piece of the TOTAL BODY BRUSH.

As shown in FIG. 2, the front side of the front piece (7) of the TOTAL BODY BRUSH should be composed of a semi-hard but flexible plastic that has been extruded and stretched to form resilient bristles (8) on a thin plastic base (9). These bristles should preferably be of a thickness and length that would make them gentle to the touch, effective for lathering, and resilient enough to withstand the constant use they will incur. The bristles should also be of a length that would not minimize the rinsing effective of the shower nozzles. The base (9) should be thin enough that it will be flexible when held by the hand.

One or more separate holes (10) should be cut out of the molded front piece (7) or formed during the molding process. These holes should be large enough for the nozzles to be pushed through.

Figure 3:
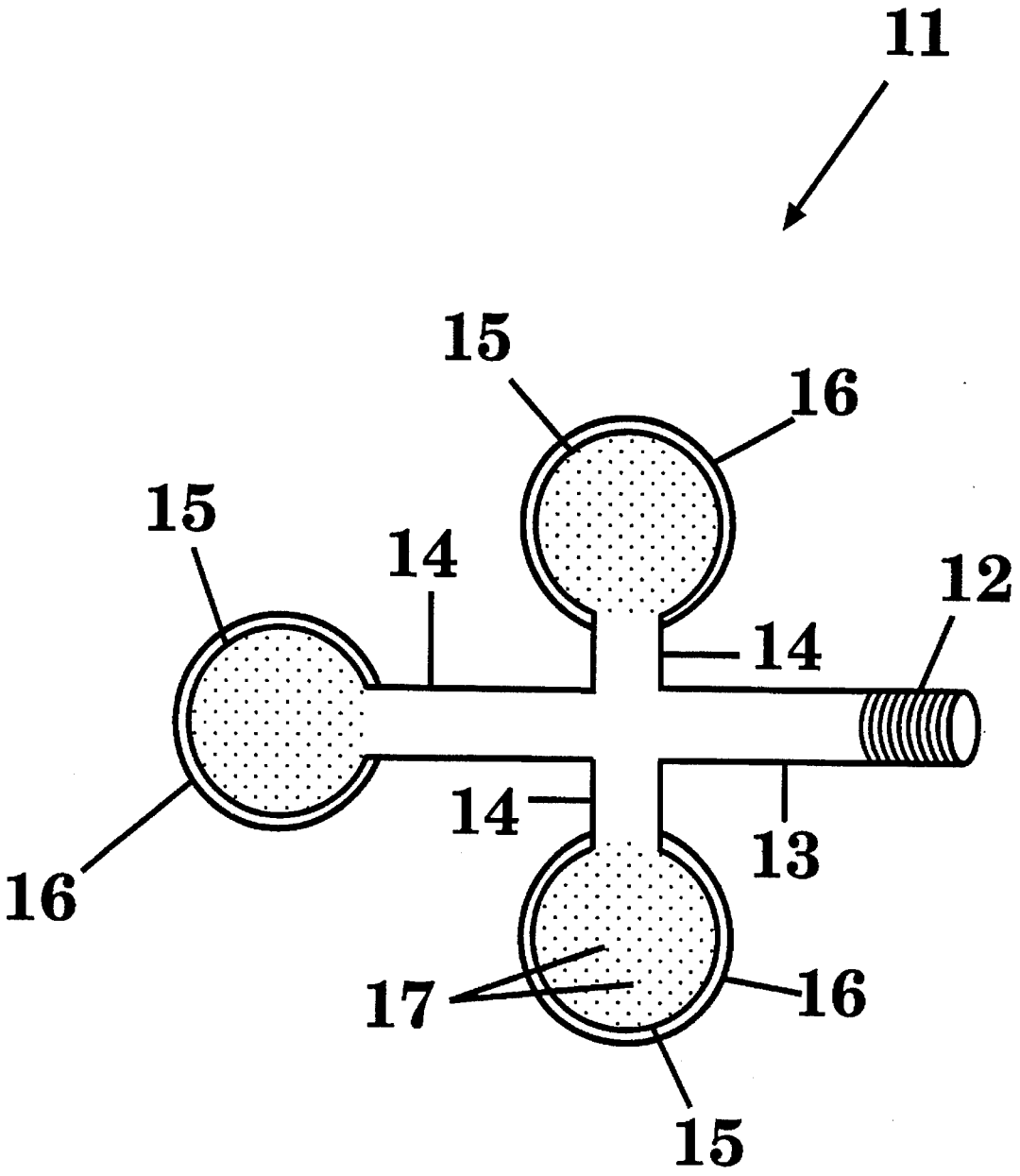
FIG. 3 is a front view of the tubing fixture inside the TOTAL BODY BRUSH.

As shown in FIG. 3, the second part of the TOTAL BODY BRUSH consists of a molded tubing fixture (11) with a male screw-type connector (12) on one end of the main tubing line (13). The main tubing line (13) may branch out into multiple separate lines (14). Each branch (14) flares out at their end into round-shaped spray nozzles (15). The spray nozzle or nozzles (15) should have an edge (16) formed around their perimeters and holes (17) perforated on their front for spraying. All tubing should be made from the same material as the front piece (7) of the brush, so that it will not impede the flexibility of the brush. All tubing should be of a diameter consistent with the tubing line (5). Enough spray holes (17) should be formed to ensure a forceful rinsing action.

Figure 4:
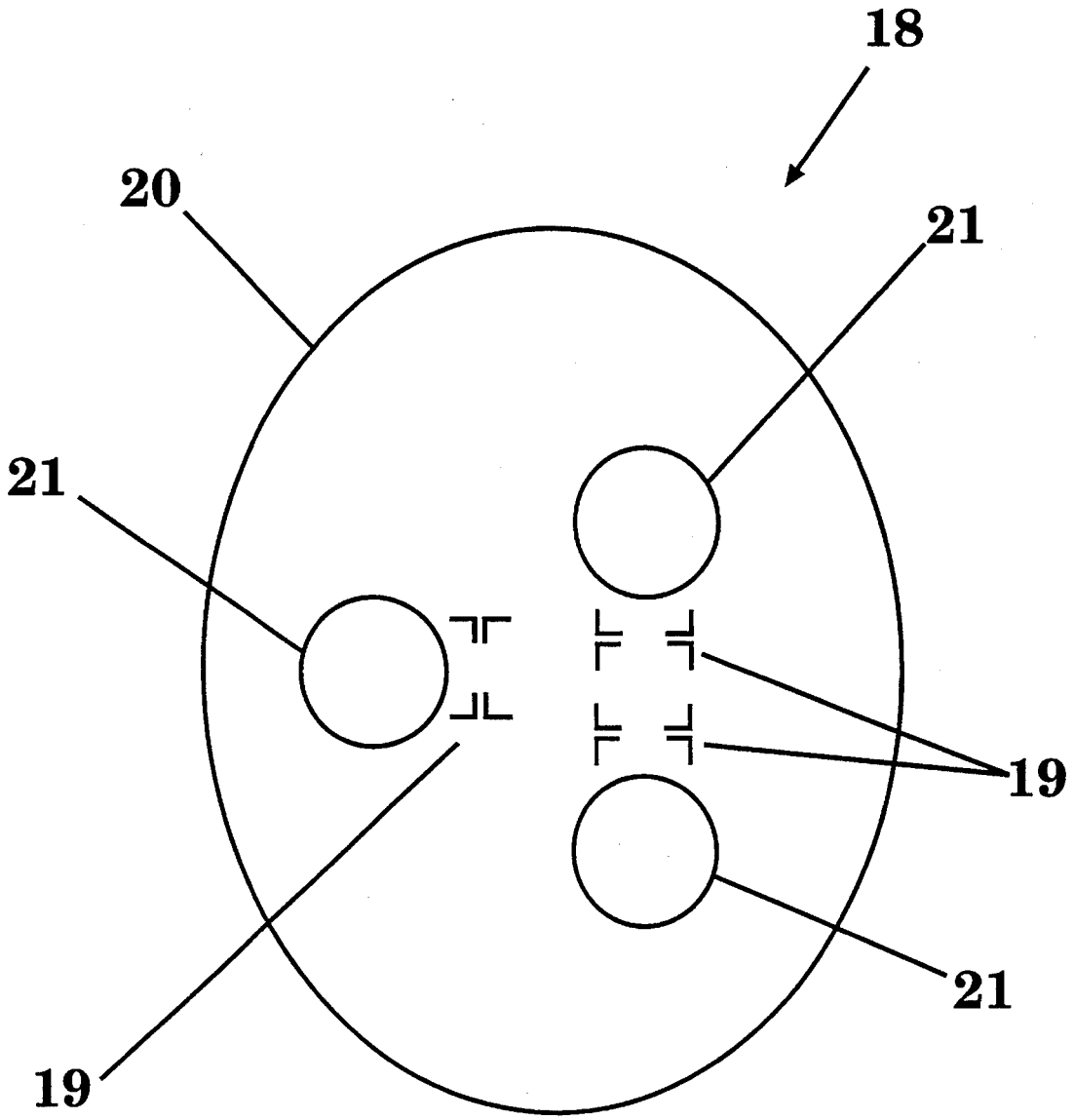
FIG. 4 is a back view of the front piece of the TOTAL BODY BRUSH.

The back of the front piece, shown as (18) in FIG. 4, has molded clamps (19) of a size appropriate for attaching each separate line (14) of the molded fixture (11) securely to it's base (20). The molded fixture (11) should be placed against the back of the front piece (18) so that the spray nozzle or nozzles (15) will be in immediate conjunction with the precut or preformed holes (21) and the tubing lines (14) fit snugly into the molded clamps (19). The spray nozzle or nozzles (15) should then be placed through the holes (21) until stopped by their edges (16). The front part of the nozzle or nozzles should then be protruding out from the base of the front piece (7) of the brush. The spray holes (17) formed in the nozzle or nozzles (15) should be facing out of the front of the front piece (7). After all connections have been made, the male screw-type connector (12) on the end of the main tubing line (13) should be outside of the perimeter of the back of the front piece (18).

Figure 5:
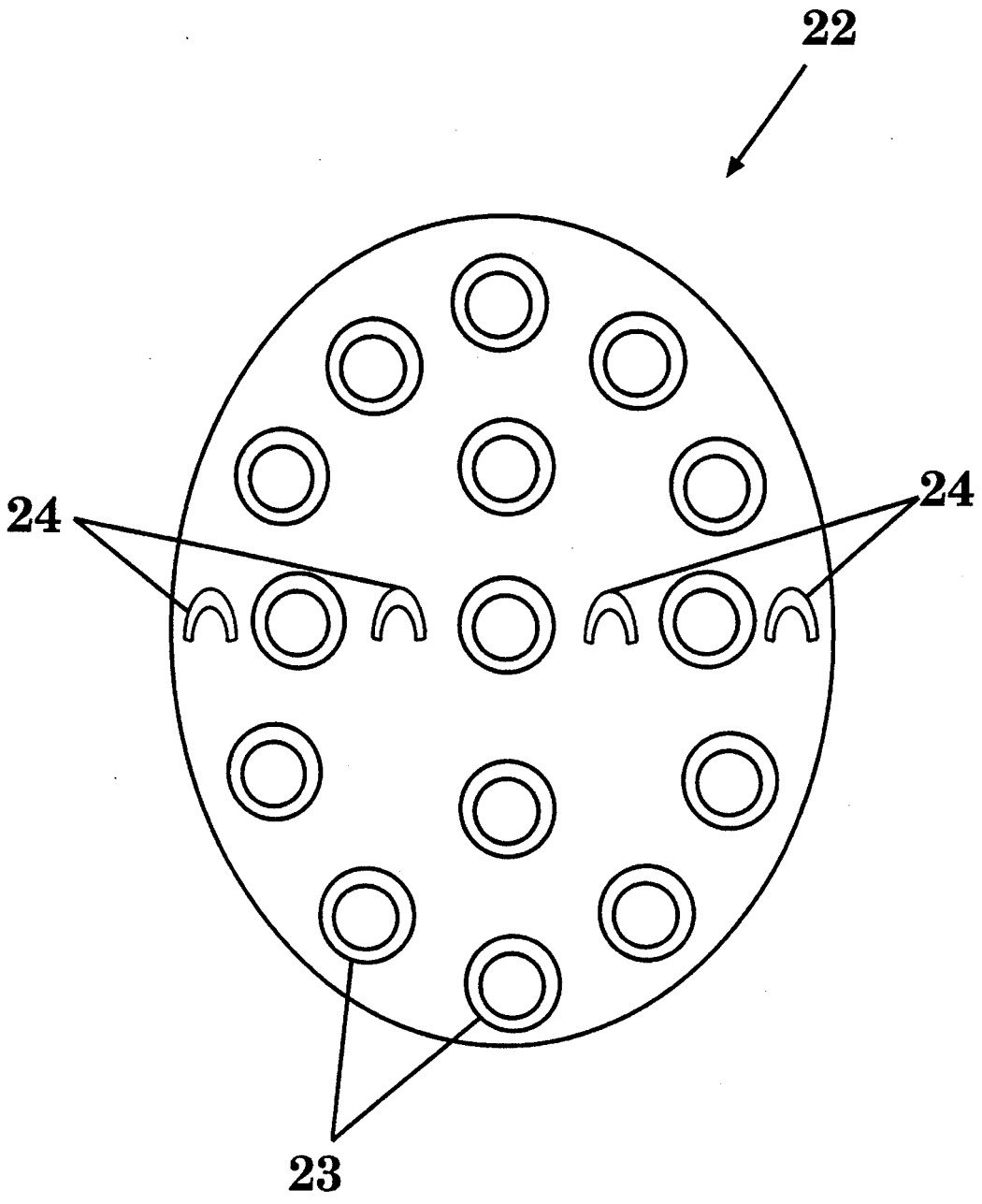
FIG. 5 is a back view of the back piece of the TOTAL BODY BRUSH.

In FIG. 5, the preferred embodiment of the back side of the back piece of the TOTAL BODY BRUSH is designated as numeral (22). It is comprised of a vinyl or rubber-like flexible plastic which has molded suctions cups (23) that have been strategically placed throughout the back piece (22). The suction cups should be of a sufficient size and length to maintain their hole on a smooth surface. Molded finger straps (24) should be placed in areas on the back piece (22) that would not be disruptive to the effectiveness of the suction cups (23). The finger straps (24) should be made from the same vinyl or rubber-like plastic material as the back piece (22). The straps (24) should be positioned on the back piece (22) so that three or more fingers could be comfortably inserted into the straps to hold the TOTAL BODY BRUSH (2) securely by the hand. The finger straps (24) should be of a width and thickness to resist breaking the periodic use. The back piece (22) should be molded in the same size and shape as the front piece (7). The front side of the back piece (22) should be relatively flat in appearance but may have slight indentations molded into the piece. This would allow the tubing line or lines (14) in the tubing fixture (11) and the clamps (19) on the back of the front piece (18) not to bulge obtrusively when the front (7) and back pieces (22) are fitted together.

The front piece (7) and the back piece (22) can now be melded together using a water and heat resistant glue, by fusing the two pieces together, or by some other method found that is deemed sufficient to prevent the pieces from coming apart in the humid environment of a bathroom. After the two pieces have been put together, the male screw-type connector (12) on the end of the main tubing line (13) should be outside of the perimeter of the constructed brush (2).

With the TOTAL BODY BRUSH, the user could comfortably hold the brush in their hand using the finger straps to clean any easily accessible places of their body. Then, using the suction cups, the brush could be attached to the shower wall, bath wall, bathtub, or any other smooth surface that is readily available. The user could then easily clean their back or any other hard to reach or difficult areas simply by rubbing the areas back and forth against the brush.

The TUBING ASSEMBLY (4) consists of an integral tubing line (5) and a regulator valve (6). The tubing line in its preferred embodiment should be made of a flexible plastic and should have a female screw-type attachment (25) at both ends to connect it to the shower plumbing and to the regulator valve (6).

Figure 6:
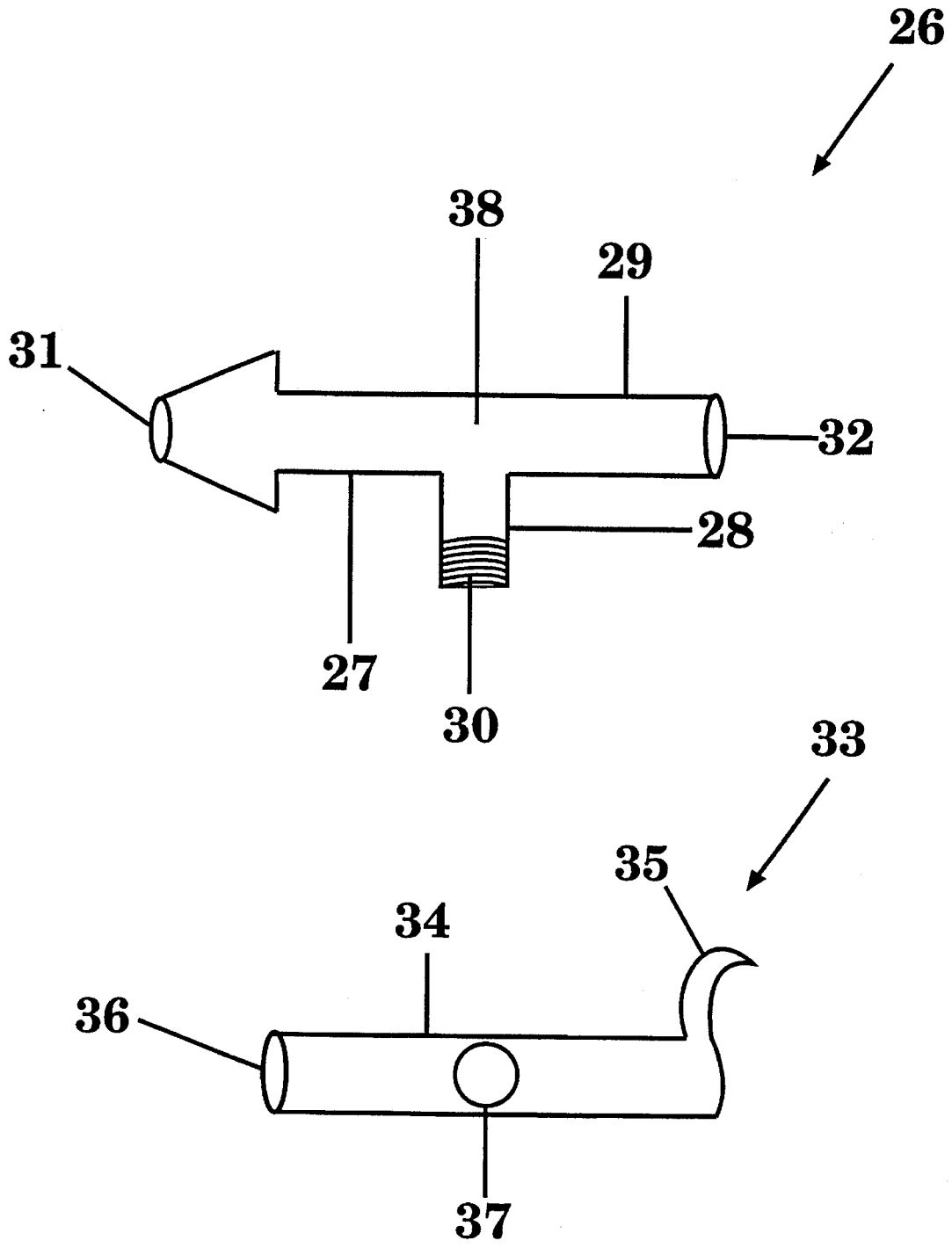
FIG. 6 are perspective views of the inside and outside parts of the regulator valve.
Figure 7:
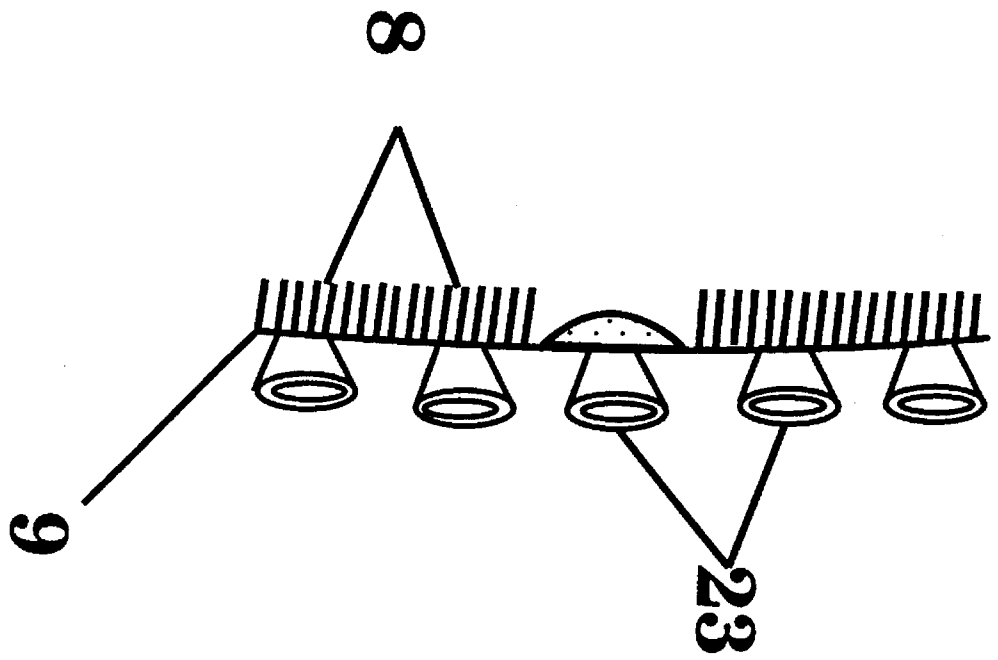
FIG. 7 is a side view of the TOTAL BODY BRUSH.

The regulator valve (6) should preferably be made of a semi-hard plastic. It would consist of two parts. The outside part (26) as shown in FIG. 6, would be formed as a tube molded into the shape of a "T". The "T" would have three ends (27, 28, 29). The bottom part of the "T" (28) would have a male screw-type connector (30) to be connected to the female screw-type attachment (25) on the tubing line (5). One end of the top part of the "T" (27) would have a female screw-type attachment (31) to be connected to the male screw-type connector (12) on the main tubing line (13). The other end of the top part of the "T" (29) would have an opening (32) to allow the second part of the valve (33) to be inserted.

The second part of the valve (33) would consist of a semi-hard plastic molded tube (34) with a handle (35) that closes one end, an outlet opening (36) on the other end, and a large inlet hole (37) in the middle of the tube (34). It should be molded so that it fits snugly when it is inserted inside the opening (32) of the outside part of the valve (26) and its inlet hole (37) would be in conjunction with the juncture of the "T" (38). When inserted, the handle (35) should rest firmly against the outside of the opening (32) of the outside part of the valve (26). The tube (34) should be long enough so that when it is inserted into the outside part of the valve (26), the outlet on the tube (36) would rest partly inside the connector (12) at the end of the main tubing line (13) on the tubing fixture (11). The tube (34) should be relatively the same size as the tubing line (5).

Thus, the flow of water would be channeled from the tubing line (5) and pass through the bottom of the "T" of the outside part of the valve (28) into the juncture of the "T"

(38). If the handle (35) is turned so that the inlet hole (37) in the middle of the inside part of the valve (33) is in conjunction with the juncture (38), the water will then pass through the inlet (37), then through the outlet (36) of the inside part of the valve (33), into the brush's main tubing line (13) and out the shower nozzles (15). The flow of water through the nozzles (15) would be required by turning the handle (35), which would put the inlet hole (37) in the middle of the inside part of the valve (33) either in or out of conjunction with the juncture (38) of the "T" on the outside part of the valve (26).

To enable the water to be sent to the brush at full force, it would be recommendable that some type of gasket be present at all connections.

Since the TOTAL BODY BRUSH (2) can be easily separated from the TUBING ASSEMBLY (4), it could be used as an individual piece apart from the TOTAL BODY BRUSH SHOWER.

Although the preferred embodiment of the TOTAL BODY BRUSH SHOWER has been described, the preceding descriptions and illustrations should not be construed to limit any modifications or improvements that would be readily envisioned by anyone skilled to the art. The following examples and many others could easily become apparent:

An attachment could be made to the TOTAL BODY BRUSH SHOWER that would allow liquid soap to be introduced into the water line for lathering.

For those without a shower faucet, a special connection could be made to attach the TOTAL BODY BRUSH SHOWER to a bathtub faucet.

Other valve regulators could be used to regulate the flow of water beside the regulator described.

Hook and loop material hand straps could be attached to the back of the TOTAL BODY BRUSH instead of the finger straps for holding the brush.

A Y connector with a shut-off valve could be improvised which would allow connections to the TOTAL BODY BRUSH SHOWER and to the regulator shower head or to another TOTAL BODY BRUSH SHOWER.

A TOTAL BODY BRUSH SHOWER without suction cups on the back could be used on pets that are afraid of or dislike water.

Two TOTAL BODY BRUSHES could be linked together by a water line. One could be attached to the wall semi-permanently for back washing, and the other could be used manually.

Different types of nozzle sprays could be made for the TOTAL BODY BRUSH SHOWER or an adjustment knob could be developed that would allow different types of shower spray settings.

A modified TOTAL BODY BRUSH SHOWER could be used for washing cars or other objects.

Bristles constructed by other means besides the type described may be utilized.

I claim:

1. A shower brush assembly comprising:

a front piece having resilient bristles on an outer surface thereof and at least one opening therethrough;

a tubing fixture comprising at least one shower nozzle with water carrying tubing attached thereto;

a back piece having a plurality of suction cups formed on a rear surface thereof, said suction cups being sufficient to attach said assembly to a wall of a shower, said back piece rear surface further having a plurality of hand attachment straps formed thereon wherein said assembly may alternatively be attached to a person's hand;

said front piece having means on a surface opposite said outer surface for attachment of said tubing;

said front piece being attached to said back piece in a manner enclosing said tubing with said at least one shower nozzle extending at least partially through said at least one opening;

means for attaching said tubing to a water source wherein water may flow from said source through said tubing and be expelled from said at least one nozzle to shower a user.

* * * * *